US011767857B2

(12) United States Patent
Amer et al.

(10) Patent No.: US 11,767,857 B2
(45) Date of Patent: Sep. 26, 2023

(54) COOLING FAN

(71) Applicant: Sunonwealth Electric Machine Industry Co., Ltd., Kaohsiung (TW)

(72) Inventors: Mohammed Abdelkareem Mostafa Amer, Kaohsiung (TW); Alex Horng

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 17/839,801

(22) Filed: Jun. 14, 2022

(65) Prior Publication Data

US 2023/0064320 A1 Mar. 2, 2023

(30) Foreign Application Priority Data

Aug. 27, 2021 (TW) ..... 110131871

(51) Int. Cl.
*F04D 29/42* (2006.01)
*F04D 17/16* (2006.01)

(52) U.S. Cl.
CPC ..... *F04D 29/4226* (2013.01); *F04D 17/16* (2013.01)

(58) Field of Classification Search
CPC ..... F04D 29/4226; F04D 29/667
See application file for complete search history.

(56) References Cited

U.S. PATENT DOCUMENTS

| | | | | |
|---|---|---|---|---|
| 9,011,092 | B2 | 4/2015 | Eguchi et al. | |
| 9,206,813 | B2 * | 12/2015 | Lin | F04D 25/08 |
| 9,644,631 | B2 | 5/2017 | Eguchi et al. | |
| 9,765,787 | B2 | 9/2017 | Cocks et al. | |
| 9,771,951 | B2 | 9/2017 | Ho | |
| 9,995,304 | B2 | 6/2018 | Lin | |
| 2005/0276689 | A1 | 12/2005 | Chiou et al. | |

FOREIGN PATENT DOCUMENTS

| | | | |
|---|---|---|---|
| CN | 1716154 | A | 1/2006 |
| CN | 209354408 | U * | 9/2019 |
| CN | 209354408 | U | 9/2019 |
| CN | 209604315 | U | 11/2019 |
| TW | I505768 | B | 10/2015 |
| WO | WO2013021366 | A2 | 2/2013 |

* cited by examiner

*Primary Examiner* — Sabbir Hasan

(57) ABSTRACT

A cooling fan includes a fan frame and an impeller. The fan frame includes a substrate, a sidewall connected to the substrate, and a lid connected to the sidewall and opposite to the substrate. An air inlet is formed in the lid. The substrate, the sidewall, and the lid together define at least one air outlet. The impeller is rotatably mounted in the fan frame. A plurality of bulges protrudes from an inner face of the sidewall and/or an inner face of the lid.

16 Claims, 14 Drawing Sheets

COOLING FAN

CROSS REFERENCE TO RELATED APPLICATION

The application claims the benefit of Taiwan application serial No. 110131871, filed on Aug. 27, 2021, and the entire contents of which are incorporated herein by reference.

BACKGROUND OF THE INVENTION

1. Field of the Invention

The present invention relates to a cooling fan and, more particularly, to a cooling fan for assisting in cooling electronic devices.

2. Description of the Related Art

FIG. 1 shows a conventional cooling fan 9 including a housing 91. The housing has a lower housing 911 and an upper housing 912, which can be coupled to the lower housing 911. An impeller 92 is rotatably mounted in the lower housing 911. The upper housing 912 includes an air inlet 913. The lower housing 911 and the upper housing 912 together define an air outlet 914. When the impeller 92 rotates, air currents pass through the air inlet 913, flow axially into the lower housing 911, and laterally flow out of the air outlet 914. An example of the conventional cooling fan 9 is disclosed in Taiwan Patent No. I505768.

The operational noise of the conventional cooling fan 9 can be reduced by the structural design of the impeller 92 at the cost of a complicated structure of the impeller 92, causing difficulties in making molds. Thus, it is difficult to produce the conventional cooling fan 9, leading to adverse influence on the production efficiency and the yield. Furthermore, the conventional cooling fan 9 has no structure for increasing the airflow and/or the air pressure. Thus, there is still room for improvement to the performance of the fan.

SUMMARY OF THE INVENTION

To solve the above problems, it is an objective of the present invention to provide a cooling fan that is easy to manufacture while increasing the airflow.

It is another objective of the present invention to provide a cooling fan that is easy to manufacture while increasing the air pressure.

It is a further objective of the present invention to provide a cooling fan that is easy to manufacture while reducing the operational noise.

As used herein, the term "a" or "an" for describing the number of the elements and members of the present invention is used for convenience, provides the general meaning of the scope of the present invention, and should be interpreted to include one or at least one. Furthermore, unless explicitly indicated otherwise, the concept of a single component also includes the case of plural components.

As used herein, the term "coupling", "engagement", "assembly", or similar terms is used to include separation of connected members without destroying the members after connection or inseparable connection of the members after connection. A person having ordinary skill in the art would be able to select according to desired demands in the material or assembly of the members to be connected.

A cooling fan according to the present invention includes a fan frame and an impeller. The fan frame includes a substrate, a sidewall connected to the substrate, and a lid connected to the sidewall and opposite to the substrate. An air inlet is formed in the lid. The substrate, the sidewall, and the lid together define at least one air outlet. The impeller is rotatably mounted in the fan frame. A plurality of bulges protrudes from at least one of an inner face of the sidewall and an inner face of the lid.

Thus, in the cooling fan according to the present invention, the fan frame can be improved by a simple structure. By providing the plurality of bulges on the inner face of the sidewall and/or the inner face of the lid, the effects of increasing the airflow and the air pressure and/or reducing the noise can be achieved, thereby improving the performance of the cooling fan. Furthermore, in comparison with the conventional cooling fans, the cooling fan according to the present invention is easy to manufacture and form, increasing the production efficiency and yield.

In an example, a first reference plane extends parallel to the at least one air outlet and passes through an axis of the impeller. An output zone is formed between the first reference plane and the at least one air outlet. At least a half of a quantity of the plurality of bulges is located in the output zone. Thus, the air currents passing through the output zone can be affected by the plurality of bulges to increase the airflow and the air pressure in the output zone.

In an example, a portion of the inner face of the sidewall forms a tail section contiguous to the at least one air outlet, and at least 80% of the quantity of the plurality of bulges on the sidewall is located in the tail section. Thus, the airflow can be significantly increased while excellently increasing the air pressure and excellently reducing the noise, thereby improving the performance of the cooling fan.

In an example, the sidewall includes a tongue adjacent to the at least one air outlet. The inner face of the sidewall has an outwardly enlarged section and a tail section. The outwardly enlarged section is connected to the tongue and extends to the at least one air outlet. The tail section is contiguous to the at least one air outlet and is opposite to the tongue. The plurality of bulges on the sidewall is disposed from the tail section along the inner face of the sidewall to a position adjacent to the tongue. The plurality of bulges is neither disposed on the tongue nor the outwardly enlarged section. Thus, the air currents can contact the plurality of bulges along the entire flow path in the fan frame, thereby improving the performance of the cooling fan.

In an example, the plurality of bulges on the sidewall is located between a half of a height of the inner face of the sidewall and an intersection of the sidewall and the substrate. Thus, the effects of increasing the airflow and the air pressure and reducing the noise can be further improved, thereby improving the performance of the cooling fan.

In an example, the plurality of bulges on the sidewall is contiguous to the intersection of the sidewall and the substrate. Thus, the effects of increasing the airflow and the air pressure and reducing the noise can be further improved, and the plurality of bulges can be more reliably disposed in predetermined locations in the fan frame, thereby improving the performance and the manufacturing convenience of the cooling fan.

In an example, all of the plurality of bulges is located on the sidewall. Thus, the fan frame is easy to manufacture and form, and the effects of increasing the airflow and the air pressure and reducing the noise can be further improved, thereby improving the manufacturing convenience and the performance of the cooling fan.

In an example, a portion of the inner face of the sidewall forms a tail section. The tail section is contiguous to the at least one air outlet. A second reference plane is orthogonal to the at least one air outlet and passes through an axis of the impeller. The plurality of bulges on the lid is located between the tail section and the second reference plane. Thus, the air pressure can be significantly increased.

In an example, a first reference plane extends parallel to the at least one air outlet and passes through an axis of the impeller. An output zone is formed between the first reference plane and the at least one air outlet. The plurality of bulges is located in the output zone. Thus, the air currents passing through the output zone can be affected by the plurality of bulges to increase the air pressure in the output zone and to reduce the operational noise.

In an example, the cooling fan further includes a flow guiding plate located in the at least one air outlet. The flow guiding plate has two ends connected to the inner face of the sidewall. Thus, the sound quality of the cooling fan can be improved, thereby reducing the noise.

In an example, the fan frame includes a supporting peg located in the at least one air outlet. The supporting peg is connected to the substrate and/or the lid. The flow guiding plate is coupled to the supporting peg. Thus, the supporting peg can prevent interference between the fan frame and the impeller while improving the stability of the flow guiding plate.

In an example, a cross sectional shape of the flow guiding plate is in a form of an airfoil. Thus, the sound quality of the cooling fan can be further improved, providing a better noise-reducing effect.

In an example, the impeller includes a plurality of blades. An edge of the flow guiding plate facing the impeller is aligned with 40-60% of a height of the plurality of blades. Thus, the sound quality of the cooling fan can be further improved, providing a better noise-reducing effect.

In an example, the substrate includes a slot extending parallel to the at least one air outlet. The slot is located below the flow guiding plate. An area of a projection of the flow guiding plate on the substrate at least partially overlaps with the slot. Thus, the effects of increasing the airflow and the air pressure and reducing the noise can be improved, thereby improving the performance of the cooling fan.

In an example, a height of the inner face of the sidewall is smaller than or equal to eight times a thickness of each of the plurality of bulges protruding from the inner face. Thus, the size of the plurality of bulges is proper to provide a better effect in improving the performance of the cooling fan.

In an example, each of the plurality of bulges has a thickness protruding beyond the inner face and ranging between 0.25 and 0.5 mm. Thus, the size of the plurality of bulges is proper to provide a better effect in improving the performance of the cooling fan.

In an example, each of the plurality of bulges has a maximum width ranging between 1.25 and 1.5 mm. Thus, the size of the plurality of bulges is proper to provide a better effect in improving the performance of the cooling fan.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
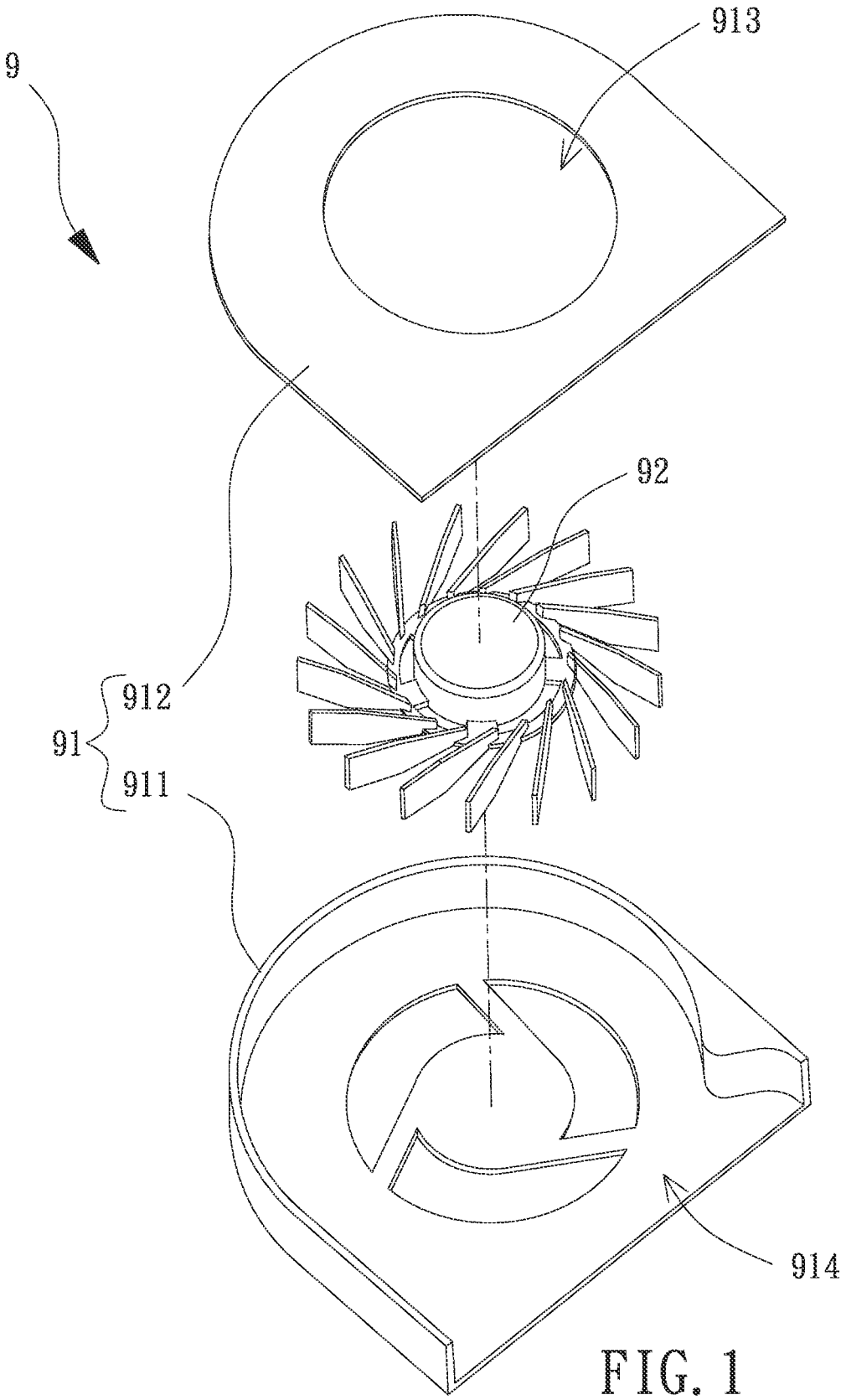
FIG. 1 PRIOR ART
FIG. 1 is an exploded, perspective view of a conventional cooling fan.

When the terms "front", "rear", "left", "right", "up", "down", "top", "bottom", "inner", "outer", "side", and similar terms are used herein, it should be understood that these terms have reference only to the structure shown in the drawings as it would appear to a person viewing the drawings and are utilized only to facilitate describing the invention, rather than restricting the invention.

DETAILED DESCRIPTION OF THE INVENTION

Figure 2:
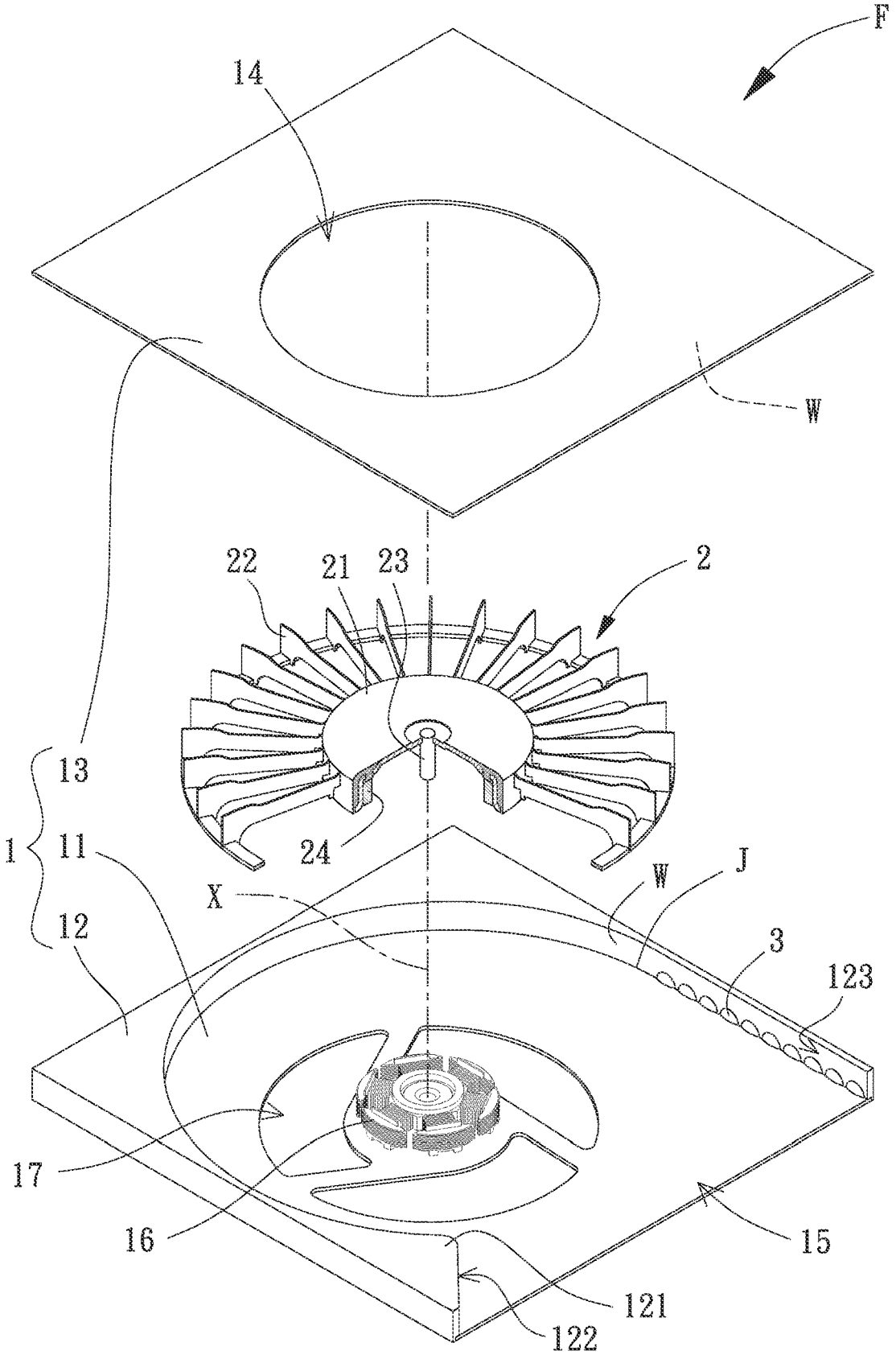
FIG. 2 is an exploded, perspective view of a cooling fan of a first embodiment according to the present invention.

FIG. 2 shows a cooling fan F of a first embodiment according to the present invention. The cooling fan F includes a fan frame 1, an impeller 2, and a plurality of bulges 3. The impeller 2 is rotatably mounted in the fan frame 1. The plurality of bulges 3 protrudes from an inner face W of the fan frame 1.

The fan frame 1 includes a substrate 11, a sidewall 12 connected to the substrate 11, and a lid 13 connected to the sidewall 12. The lid 13 is opposite to the substrate 11. Each of the sidewall 12 and the lid 13 has an inner face W facing an interior of the fan frame 1. The fan frame 1 includes an air inlet 14 located in the lid 13. The substrate 11, the sidewall 12, and the lid 13 together define an air outlet 15. In this embodiment, the substrate 11 may be made of metal, the sidewall 12 may be made of plastic material, and the sidewall 12 may be integrally formed with the substrate 11 by injection molding. Thus, the fan frame 1 may have a proper structural strength, and the sidewall 12 can be easily formed to have various shapes according to different needs. The lid 13 may be made of metal or plastic material according to need.

Figure 3:
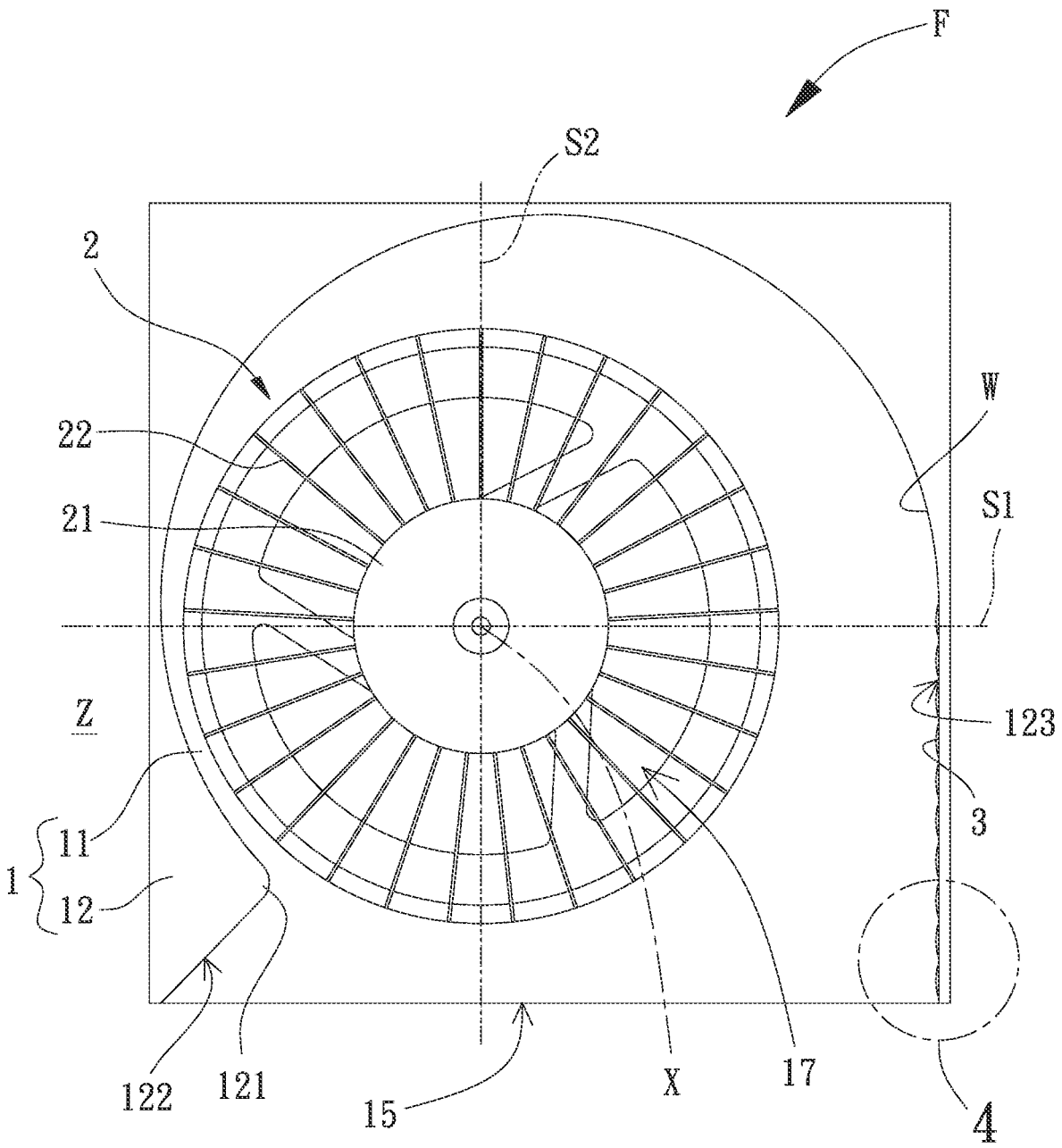
FIG. 3 is a top view of the cooling fan of the first embodiment according to the present invention with a lid removed.

With reference to FIGS. 2 and 3, a stator 16 can be coupled to the substrate 11 of this embodiment. Furthermore, the fan frame 1 of this embodiment may include at least one auxiliary air inlet 17. The at least one auxiliary air inlet 17 may be formed in the substrate 11, such that air can enter via the air inlet 14 and the at least one auxiliary air inlet 17 when the cooling fan F operates. The sidewall 12 of this embodiment may include a tongue 121. The tongue 121 is adjacent to the air outlet 15 and is in the form of a protrusion. A portion of the inner face W of the sidewall 12 may form an outwardly enlarged section 122. The outwardly enlarged section 122 may be connected to the tongue 121 and extends to the air outlet 15. A portion of the inner face W of the sidewall 12 may further form a tail section 123. The tail section 123 is contiguous to the air outlet 15 and is substantially opposite to the tongue 121. For example, when the tongue 121 is located on the left side of the air outlet 15, the tail section 123 may be substantially located on the right side of the air outlet 15. In this embodiment, the tail section 123 is approximately on the right side of FIG. 3 and begins from an intersection of an arcuate line and a rectilinear line of the inner face W of the sidewall 12 to the air outlet 15. In another embodiment, the tail section 123 may extend non-rectilinearly.

The impeller 2 includes a hub 21 and a plurality of blades 22 disposed around the hub 21. The impeller 2 includes a shaft 23 and a magnetic member 24 which are separately and securely positioned on the hub 21. A longitudinal axis of the shaft 23 defines an axis X of the impeller 2. The shaft 23 is rotatably mounted to a center of the stator 16. The magnetic member 24 and the stator 16 are opposite to each other and are spaced from each other by a magnetic induction gap. Thus, when the stator 16 is energized to generate a magnetic field, the whole impeller 2 is driven to rotate, driving air currents to flow via the air inlet 14 into the interior of the fan frame 1 and then flow outward via the air outlet 15. A first reference plane S1 extends parallel to the air outlet 15 and passes through the axis X of the impeller 2. An output zone Z is formed between the first reference plane S1 and the air outlet 15. The tongue 121, the outwardly enlarged section 122, and the tail section 123 of the sidewall 12 may be located in the output zone Z. A second reference plane S2 is orthogonal to the air outlet 15 and passes through the axis X of the impeller 2.

The plurality of bulges 3 protrudes from the inner face W of the sidewall 12 and/or the inner face W of the lid 13 to affect the air currents flowing in the interior of the fan frame 1. In this embodiment, all of the plurality of bulges 3 may be located on the inner face W of the sidewall 12. Furthermore, at least a half of the plurality of bulges 3 may be located in the output zone Z. Thus, the air currents passing through the output zone Z can be affected by the plurality of bulges 3. Turbulence can be generated on the surfaces of the plurality of bulges 3 to delay separation of the air currents, thereby generating small vortexes and reducing the resistance. Thus, effects of increasing the airflow and the air pressure and/or reducing the noise can be provided, and these effects can be proven by experiments, which will be set forth hereinafter.

Figure 4:
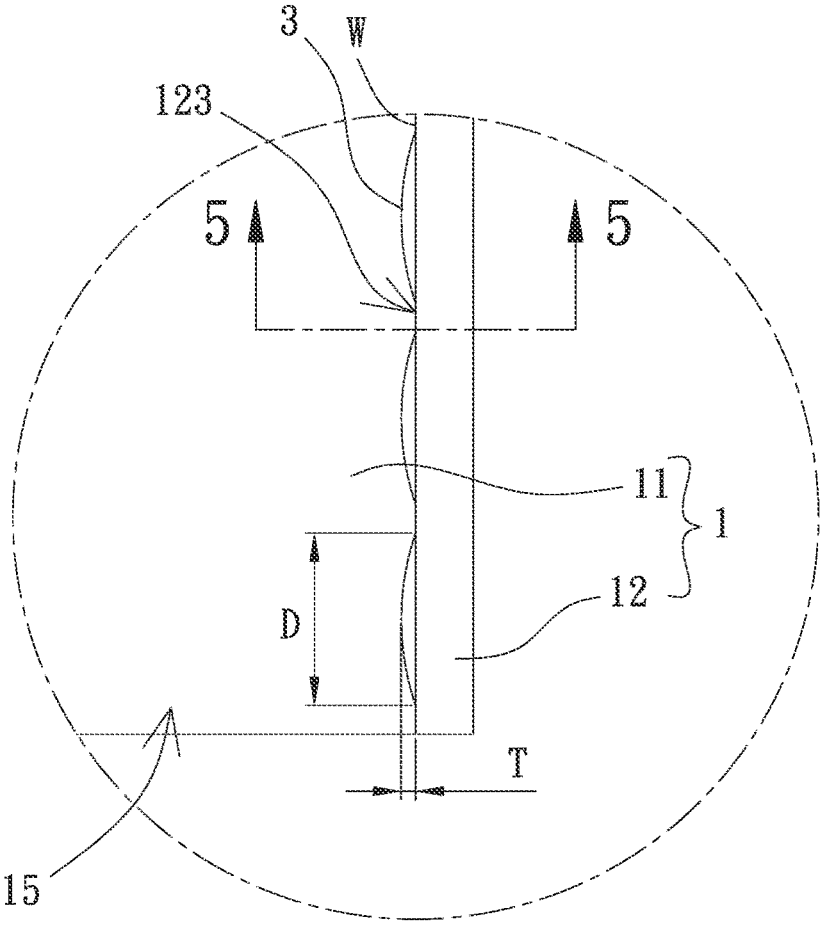
FIG. 4 is an enlarged view of a circled portion 4 of the cooling fan of the first embodiment as shown in FIG. 3.
Figure 5:
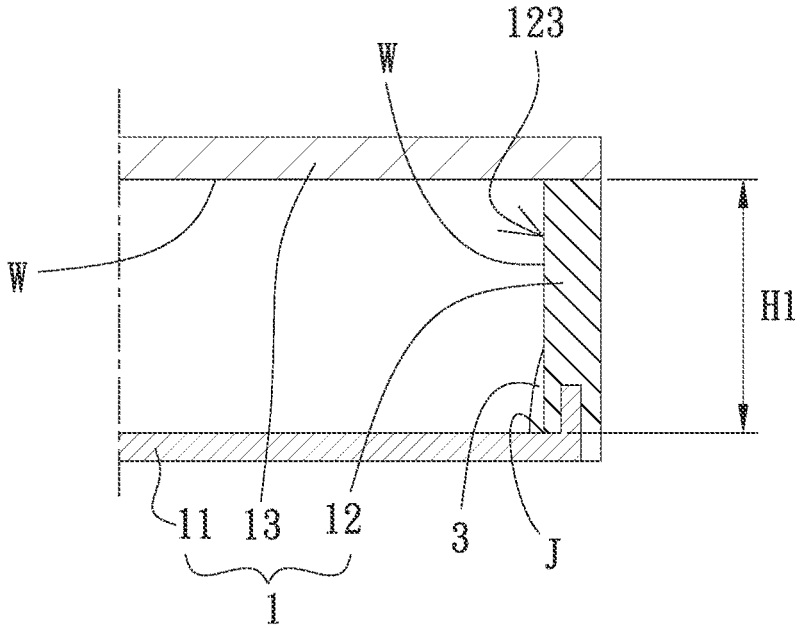
FIG. 5 is a cross sectional view taken along section line 5-5 of FIG. 4.

With reference to FIGS. 2 and 4, the plurality of bulges 3 protrudes from the inner face W of the sidewall 12. In this embodiment, the plurality of bulges 3 may be formed while proceeding with injection molding of the sidewall 12 made of plastic material, such that the plurality of bulges 3 can be integrally formed and connected with the sidewall 12. Nevertheless, the present invention is not limited in this regard. The plurality of bulges 3 may be identical or different in sizes or shapes. Each of the plurality of bulges 3 is preferably in the form of a hemisphere protruding from the inner face W of the sidewall 12 and is connected to the inner face W of the sidewall 12 by the maximum width D of the respective bulge 3. With reference to FIGS. 4 and 5, the height H1 of the inner face W of the sidewall 12 is preferably smaller than or equal to eight times the thickness T of each of the plurality of bulges 3 protruding from the inner face W. In this embodiment, each of the plurality of bulges 3 has a thickness T protruding beyond the inner face W and ranging between 0.25 and 0.5 mm and has a maximum width D ranging between 1.25 and 1.5 mm.

With reference to FIGS. 2 and 5, in this embodiment, the plurality of bulges 3 is located between a half of the height H1 of the inner face W of the sidewall 12 and an intersection J of the sidewall 12 and the substrate 11. The plurality of bulges 3 is preferably contiguous to the intersection J of the sidewall 12 and the substrate 11. Preferably, at least 80% of the plurality of bulges 3 is located in the tail section 123. Thus, the effects of increasing the airflow and the air pressure and reducing the noise can be further improved.

Figure 6:
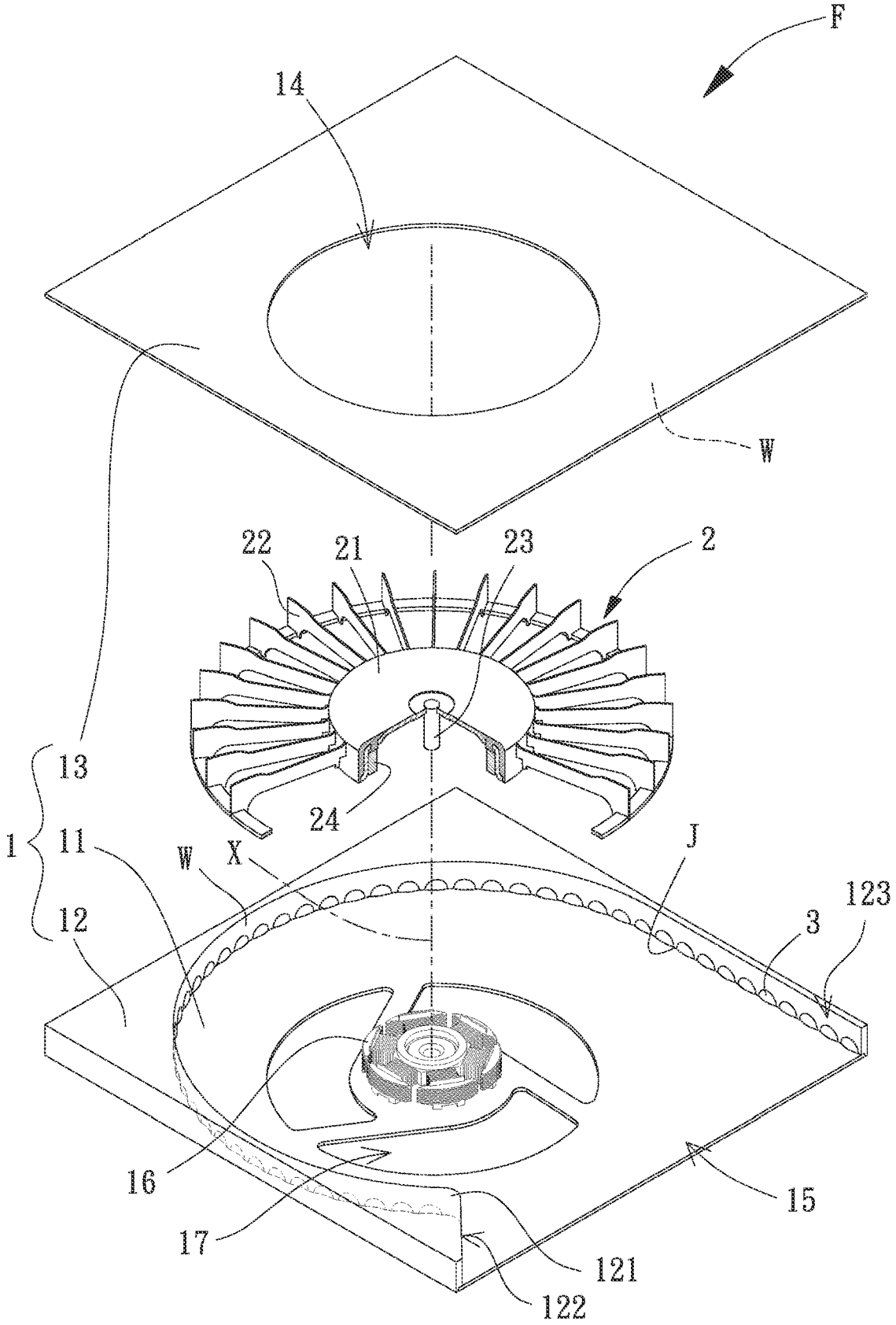
FIG. 6 is an exploded, perspective view of a cooling fan of a second embodiment according to the present invention.

FIG. 6 shows a cooling fan F of a second embodiment according to the present invention. This embodiment is substantially the same as the first embodiment. Similarly, all of the plurality of bulges 3 of the cooling fan F is located on the inner face W of the sidewall 12. The main difference resides in that the plurality of bulges 3 of this embodiment is disposed in a wider area.

Specifically, the plurality of bulges 3 may be disposed from the tail section 123 along the inner face W of the sidewall 12 to a position adjacent to the tongue 121, and the tongue 121 and the outwardly enlarged section 122 are free of the plurality of bulges 3. Thus, the air currents can contact the plurality of bulges 3 along the entire flow path in the interior of the fan frame 1.

Figure 7:
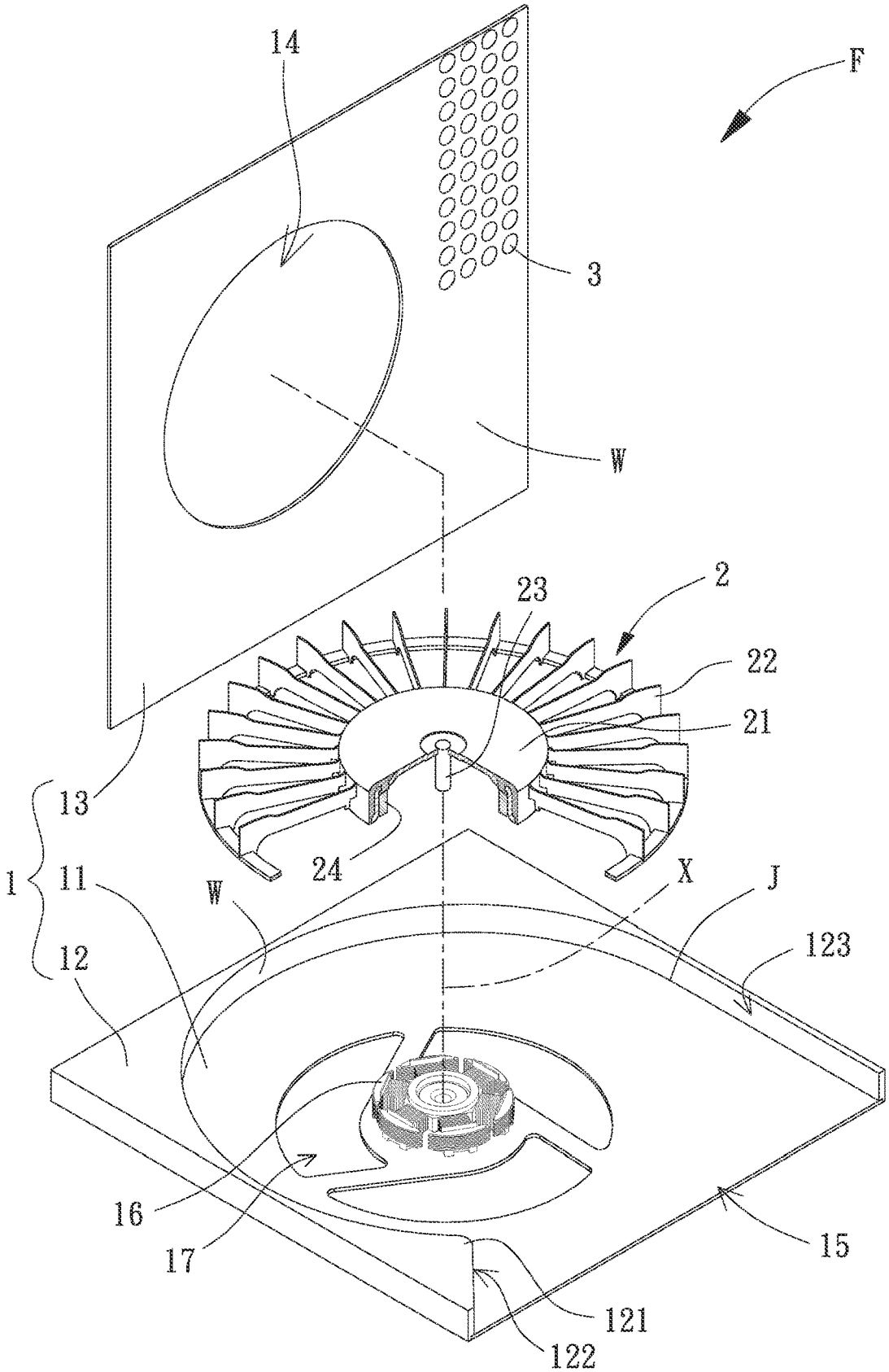
FIG. 7 is an exploded, perspective view of a cooling fan of a third embodiment according to the present invention.
Figure 8:
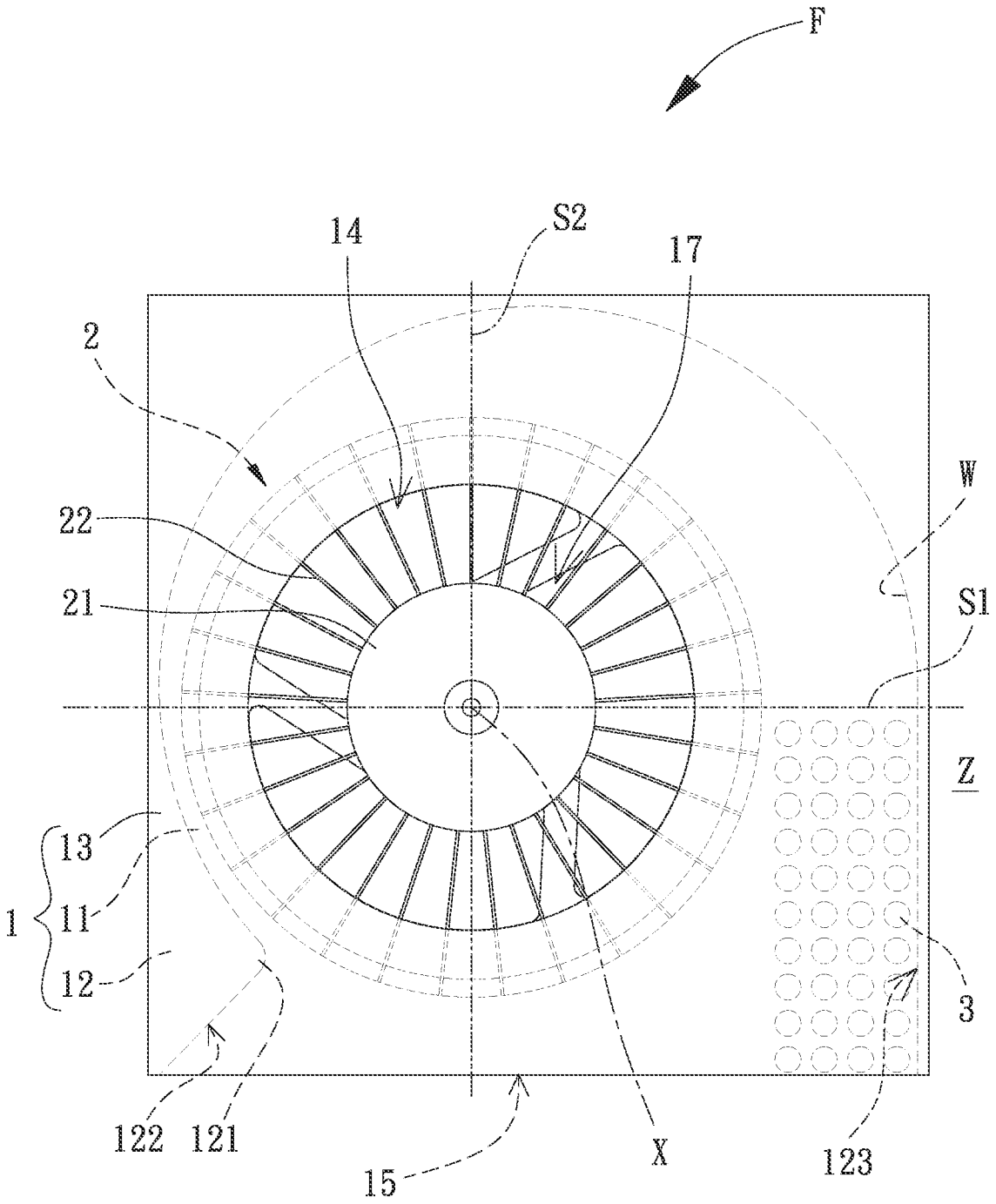
FIG. 8 is a top view of the cooling fan of the third embodiment according to the present invention.

FIGS. 7 and 8 show a cooling fan F of a third embodiment according to the present invention. This embodiment is substantially the same as the second embodiment. The main difference resides in that the plurality of bulges 3 of this embodiment is located on the inner face W of the lid 13 rather than the inner face W of the sidewall 12.

Specifically, the plurality of bulges 3 of this embodiment may be distributed on the inner face W of the lid 13 in an array. The plurality of bulges 3 may be located between the tail section 123 and the second reference plane S2. Preferably, the plurality of bulges 3 is adjacent to the tail section 123 and remote from the second reference plane S2. Alternatively, all of the plurality of bulges 3 may be located in the output zone Z. Thus, the effects of increasing the air pressure and reducing the noise can also be achieved, and the effect of increasing the air pressure is more obvious (which can be proven by experiments set forth hereinafter). Furthermore, since the plurality of bulges 3 is disposed on the lid 13 in this embodiment, the plurality of bulges 3 may be formed by a pressing process when the lid 13 is made of metal, such that a plurality of dimples can be formed on an outer face of the lid 13 while forming a plurality of bulges 3 on the inner face W of the lid 13. Furthermore, in a case that the lid 13 is made of plastic material, the plurality of bulges 3 may be formed while forming the lid 13, such that the plurality of bulges 3 can be integrally formed and connected with the lid 13. Alternatively, the plurality of bulges 3 can be adhered to the inner face W of the lid 13 after formation of the lid 13. The present invention is not limited in this regard.

Figure 9:
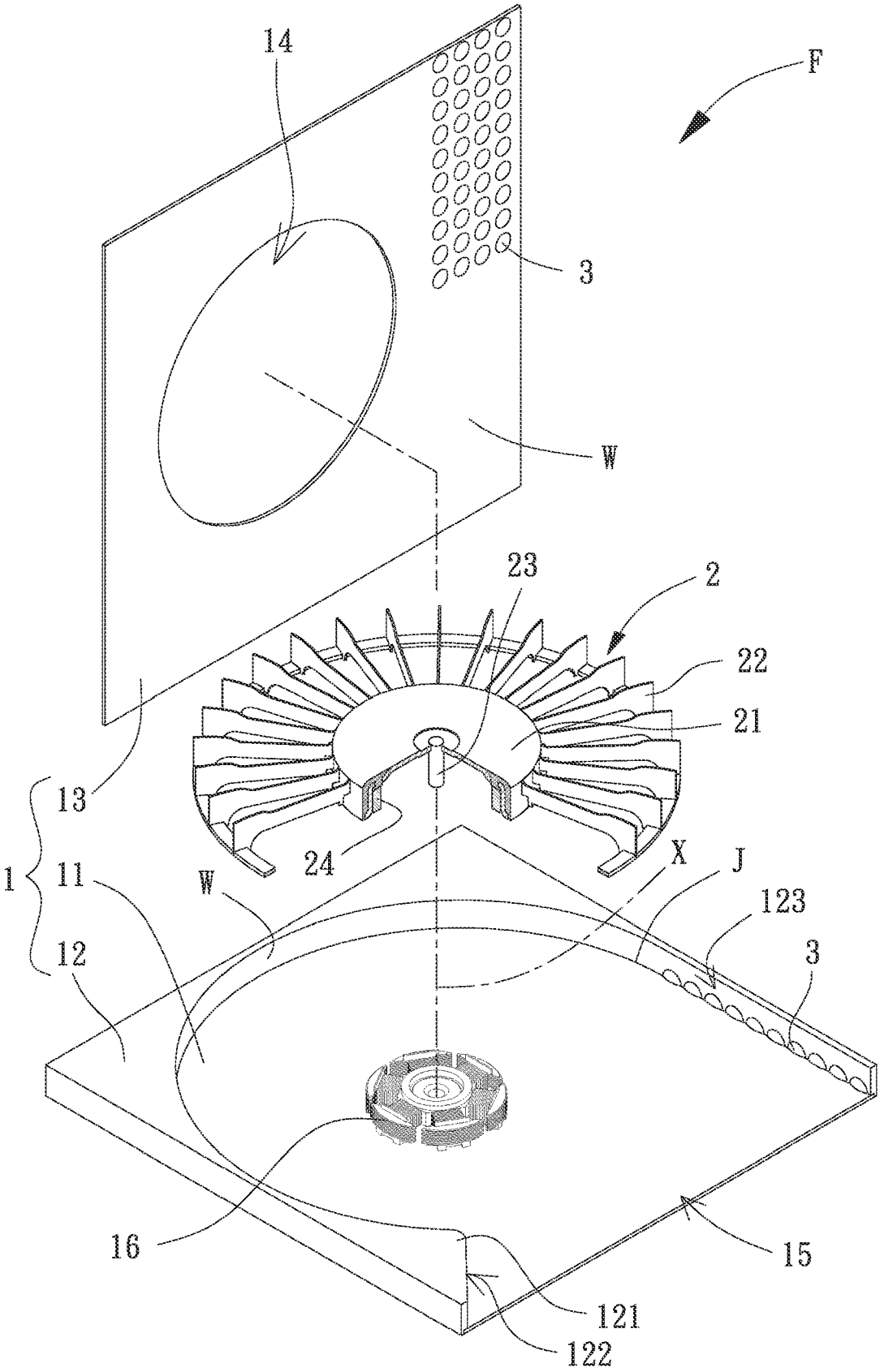
FIG. 9 is an exploded, perspective view of a cooling fan of a fourth embodiment according to the present invention.

FIG. 9 shows a cooling fan F of a fourth embodiment according to the present invention. In this embodiment, a portion of the plurality of bulges 3 protrudes from the inner face W of the sidewall 12, and another portion of the plurality of bulges 3 protrudes from the inner face W of the lid 13. Nevertheless, the disposition of the bulges 3 is not limited to the patterns disclosed in this figure. Furthermore, the auxiliary air inlet 17 (FIG. 2) may be omitted in the fan frame 1 of this embodiment. Nevertheless, in the present invention, it is not limited to dispose the bulges 3 on the frame 1 without the auxiliary air inlet 17. Namely, the fan frame 1 of each embodiment according to the present invention may or may not include the auxiliary air inlet 17, and disposition of the auxiliary air inlet 17 is irrelevant to the disposition pattern of the plurality of bulges 3.

Figure 10:
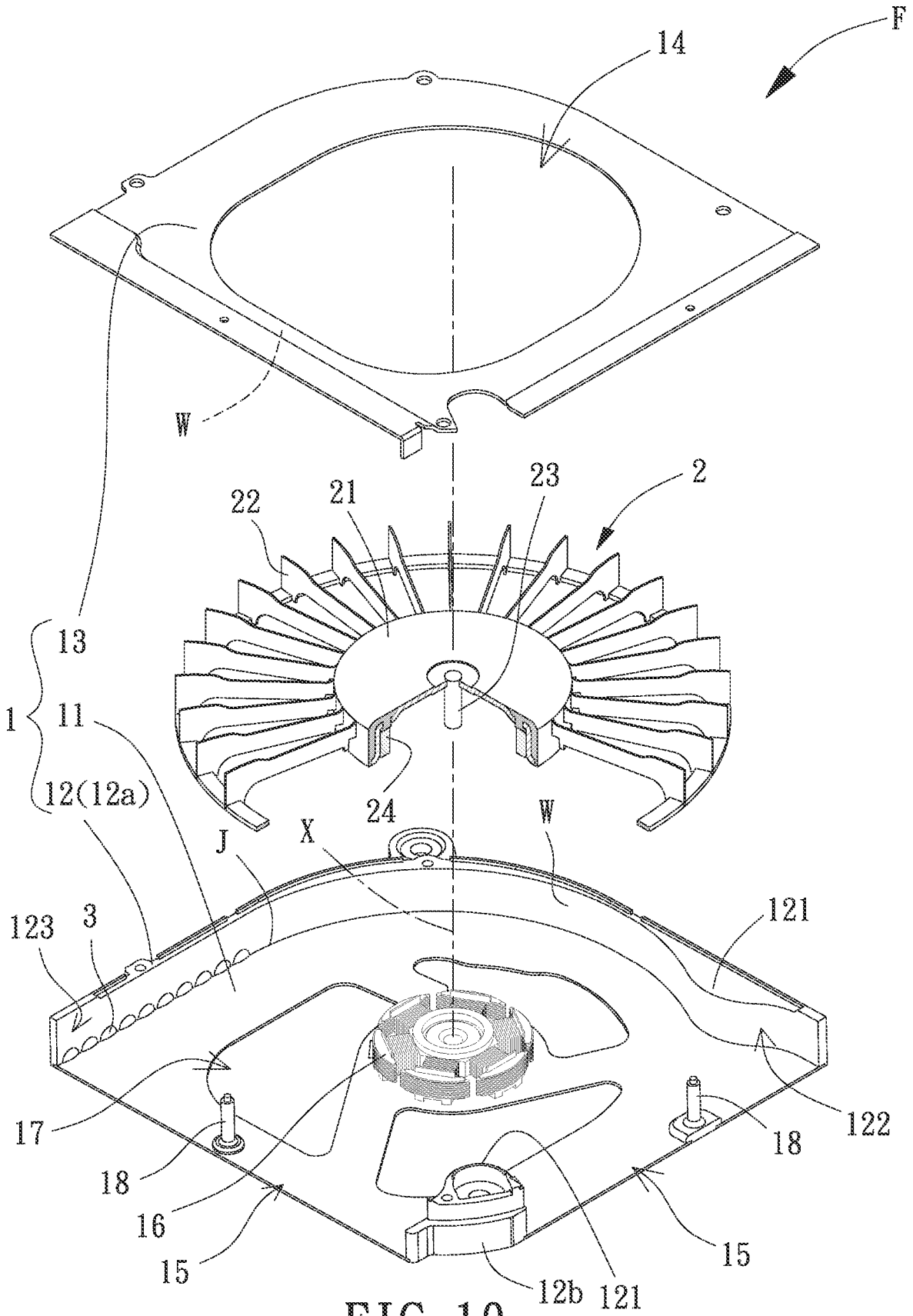
FIG. 10 is an exploded, perspective view of a cooling fan of a fifth embodiment according to the present invention.

FIG. 10 shows a cooling fan F of a fifth embodiment according to the present invention. This embodiment is substantially the same as the first embodiment. The main difference resides in that the fan frame 1 of this embodiment has two air outlets 15, and the orientations of the two air outlets may be different.

Specifically, in the fan frame 1 of this embodiment, the sidewall 12 may include a first section 12*a* and a second section 12*b* discontinuous to the first section 12*a*. As viewed from top of the fan frame 1, the substrate 11 may be substantially rectangular. The first section 12*a* of the sidewall 12 may be substantially L-shaped and is connected to two adjoining edges of the substrate 11. The second section 12*b* of the sidewall 12 may be connected to an intersection of another two adjoining edges of the substrate 11. After the lid 13 is connected to the first section 12*a* and the second section 12*b* of the sidewall 12, one of the two air outlets 15 may be located between the second section 12*b* and an end of the first section 12*a*, and another of the two air outlets 15 may be located between the second section 12*b* and another end of the first section 12*a*, such that the orientations of the two air outlets 15 are substantially orthogonal to each other. Nevertheless, the present invention is not limited in this regard.

The outwardly enlarged section 122 and the tail section 123 of the sidewall 12 may be located on the two ends of the first section 12*a* of the sidewall 12, respectively. The second section 12*b* of the sidewall 12 may also form a tongue 121. Generally, the air outlet 15 between the tail section 123 and the tongue 121 of the second section 12*b* of the sidewall 12 is the primary air outlet 15, whereas the air outlet 15 between the outwardly enlarged section 122 and the tongue 121 of the second section 12*b* of the sidewall 12 is the auxiliary air outlet 15. Thus, the plurality of bulges 3 is preferably disposed adjacent to the primary air outlet 15. The first reference plane S1 and the second reference plane S2 (see FIG. 8) of the cooling fan F of this embodiment are defined with respect to the primary air outlet 15.

Furthermore, the fan frame 1 may further include at least one supporting peg 18. The supporting peg 18 is connected to the substrate 11 and/or the lid 13 to prevent interference with the rotating impeller 2 when the substrate 11 or the lid 13 is subject to pressure. The supporting peg 18 is located in the air outlet 15 to achieve a better supporting effect. In this embodiment, each of the two air outlets 15 has a supporting peg 18 disposed therein to thoroughly prevent interference between the fan frame 1 and the impeller 2.

Figure 11:
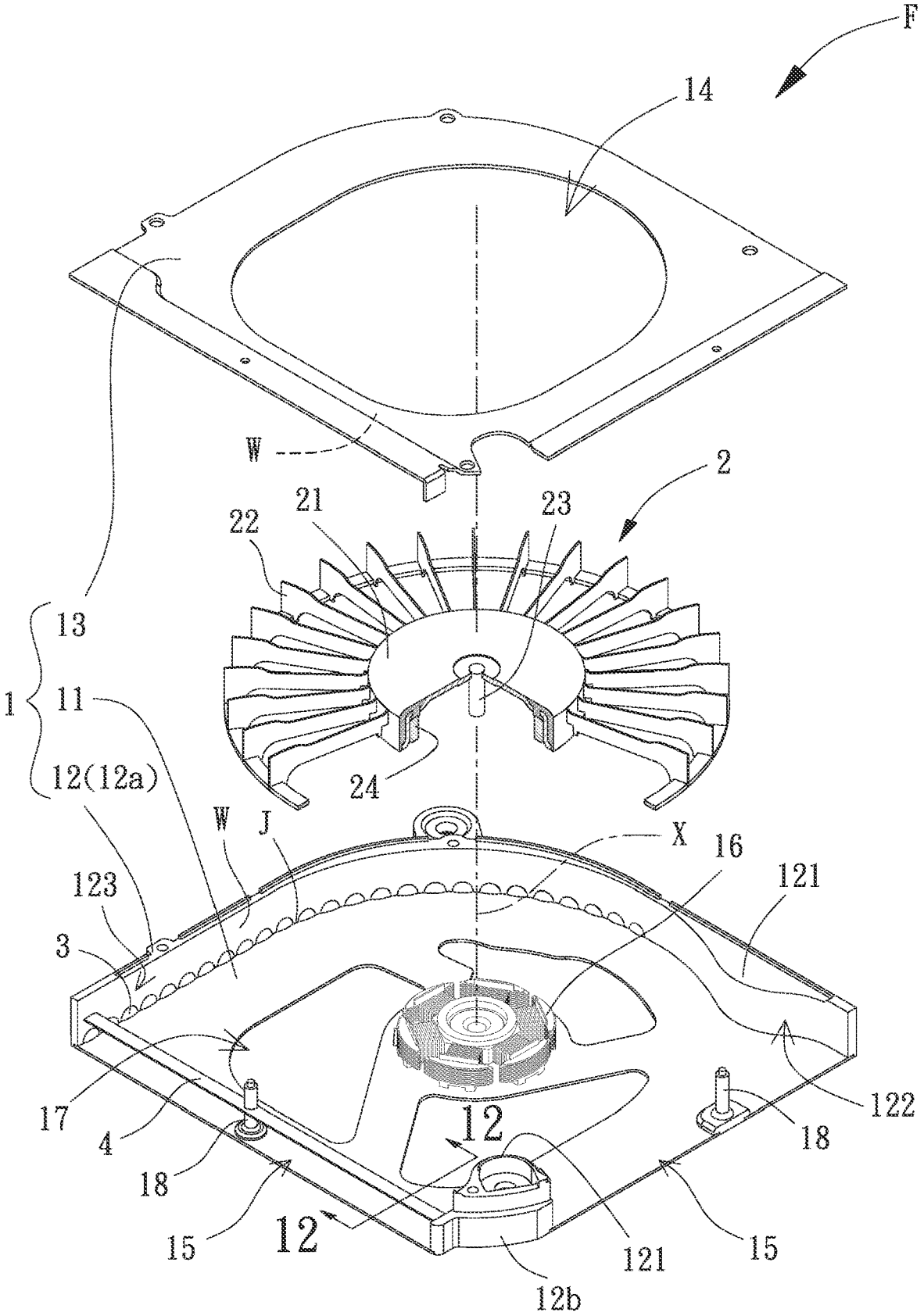
FIG. 11 is an exploded, perspective view of a cooling fan of a sixth embodiment according to the present invention.

FIG. 11 shows a cooling fan F of a sixth embodiment according to the present invention. This embodiment is substantially the same as the fifth embodiment. The main difference resides in that the cooling fan F of this embodiment further includes at least one flow guiding plate 4.

Specifically, when there is only one flow guiding plate 4, the flow guiding plate 4 is preferably located in the primary air outlet 15. When there are two flow guiding plates 4, the two flow guiding plates 4 are disposed in the two air outlets 15, respectively. Two ends of the flow guiding plate 4 may be connected to the inner face W of the sidewall 12. According to the type of the fan frame 1 of this embodiment, an end of the flow guiding plate 4 may be connected to the first section 12*a* of the sidewall 12, whereas the other end of the flow guiding plate 4 may be connected to the second section 12*b* of the sidewall 12, such that the flow guiding plate 4 extends transversely in the air outlet 15. In the embodiment including the supporting peg 18, the flow guiding plate 4 may be coupled to the supporting peg 18. For example, the supporting peg 18 is coupled by extending through the flow guiding plate 4 to improve the stability of the flow guiding plate 4.

Figure 12:
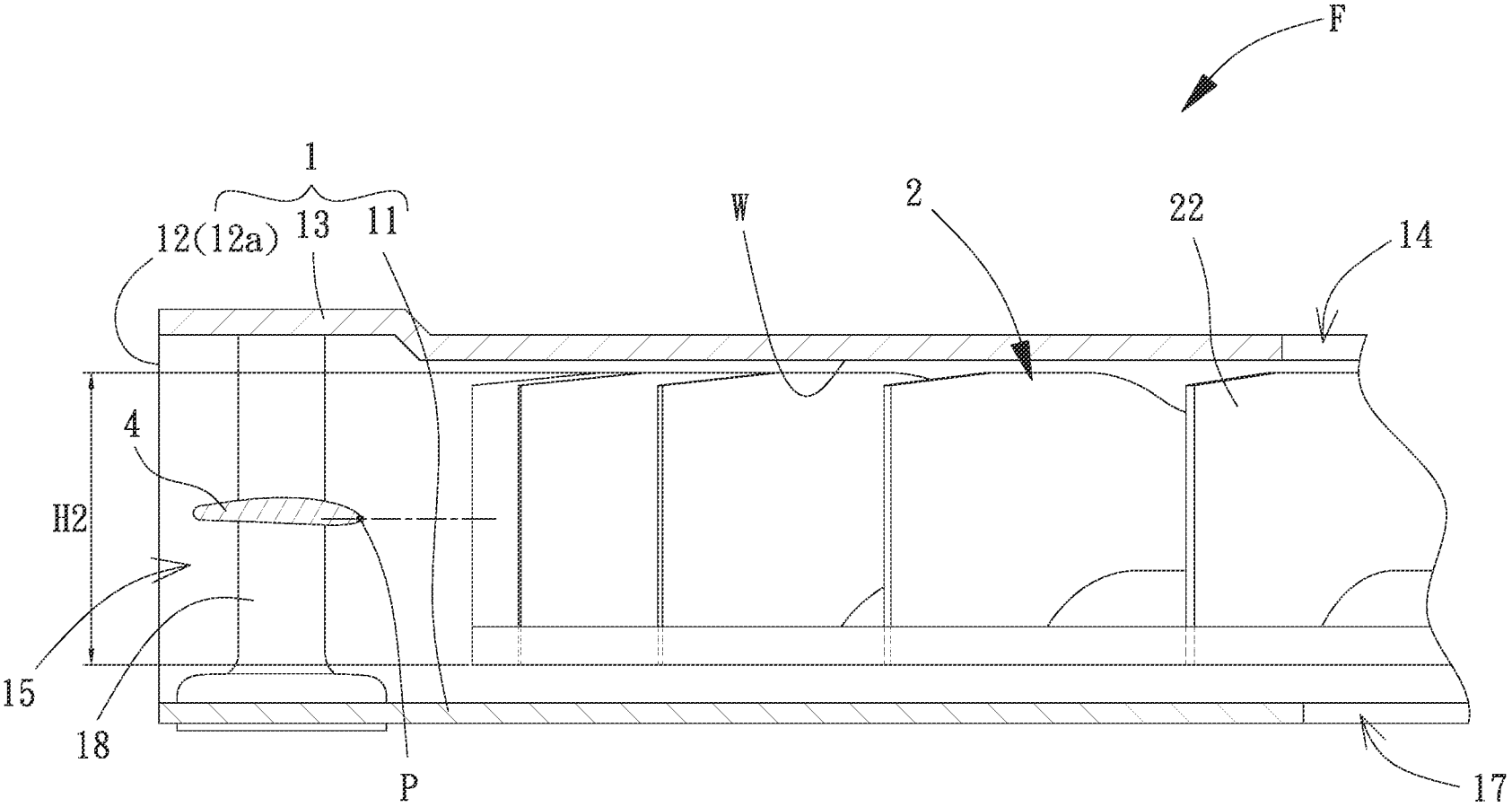
FIG. 12 is a cross sectional view taken along section line 12-12 of FIG. 1.

With reference to FIG. 12, the cross sectional shape of the flow guiding plate 4 may be rectangular, elliptic or, preferably, in the form of an airfoil. An edge P of the flow guiding plate 4 facing the impeller 2 is aligned with 40-60% of a height H2 of the plurality of blades 22, preferably 50% of the height H2. Thus, when the air outlet 15 has the flow guiding plate 4 disposed therein, the flow guiding plate 4 may generate an effect similar to the plurality of bulges 3.

Figure 13:
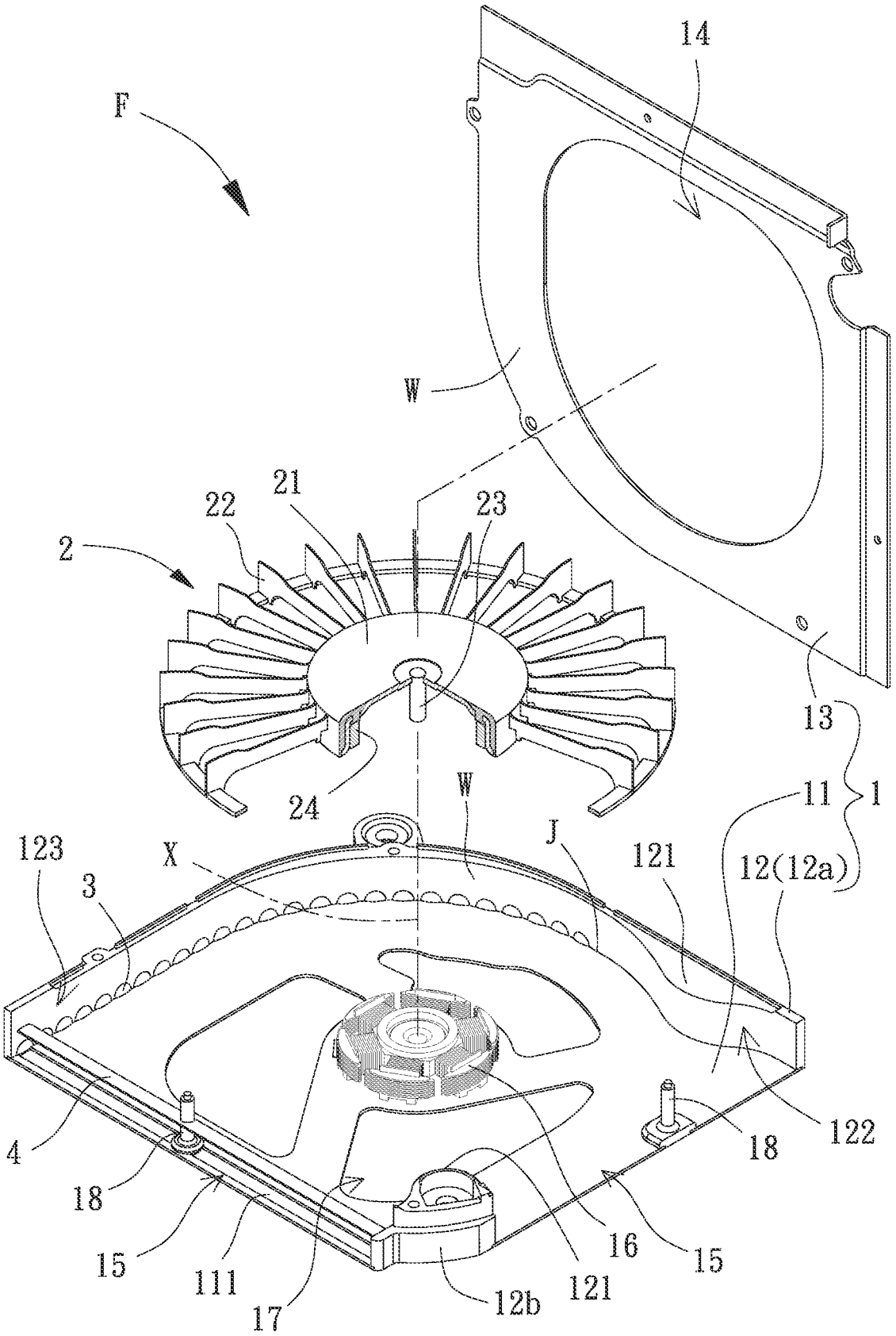
FIG. 13 is an exploded, perspective view of a cooling fan of a seventh embodiment according to the present invention.

FIG. 13 shows a cooling fan F of a seventh embodiment according to the present invention. This embodiment is substantially the same as the sixth embodiment. The main difference resides in that the substrate 11 may further include a slot 111 adjacent to the air outlet 15.

Specifically, the slot 111 of the substrate 11 may extend parallel to the air outlet 15. In this embodiment, two ends of the slot 111 extends to the sidewall 12. Nevertheless, the present invention is not limited in this regard. Furthermore, the slot 111 of the substrate 11 may be located below the flow guiding plate 4, such that an area of a vertical projection of the flow guiding plate 4 formed on the substrate 11 at least partially overlaps with the slot 111.

To prove the above effects, the present invention uses a comparative cooling fan, a first cooling fan, a second cooling fan, a third cooling fan, and a fourth cooling fan to proceed with tests of airflow, air pressure, and noise (such as by computer software simulation and numerical analysis). Each of the fan frames of the comparative cooling fan and the first to fourth cooling fans includes only one air outlet, and the comparative cooling fan does not include the features of the bulges, the flow guiding plate, and the slot mentioned above. Using the comparative cooling fan as a reference, each of the first to third cooling fans further includes a plurality of bulges 3. Furthermore, the disposition pattern of the plurality of bulges 3 of the first cooling fan is shown in FIG. 2, the disposition pattern of the plurality of bulges 3 of the second cooling fan is shown in FIG. 6, and the disposition pattern of the plurality of bulges 3 of the third cooling fan is shown in FIG. 7, such that the variable of the first to third cooling fans relative to the comparative cooling fan is the disposition pattern of the plurality of bulges 3. Furthermore, using the first cooling fan as a reference, the fourth cooling fan further includes a flow guiding plate 4 and a slot 111 (see FIG. 13), but the fourth cooling fan is not the type shown in FIG. 13. Namely, the fourth cooling fan includes the features of the plurality of bulges 3, the flow guiding plate 4, and the slot 111. Furthermore, the disposition pattern of the plurality of bulges 3 is shown in FIG. 2, such that the variables of the fourth cooling fan relative to the comparative cooling fan are the plurality of bulges 3, the flow guiding plate 4, and the slot 111, whereas the variables of the fourth cooling fan relative to the first cooling fan are the flow guiding plate 4 and the slot 111.

Figure 14:
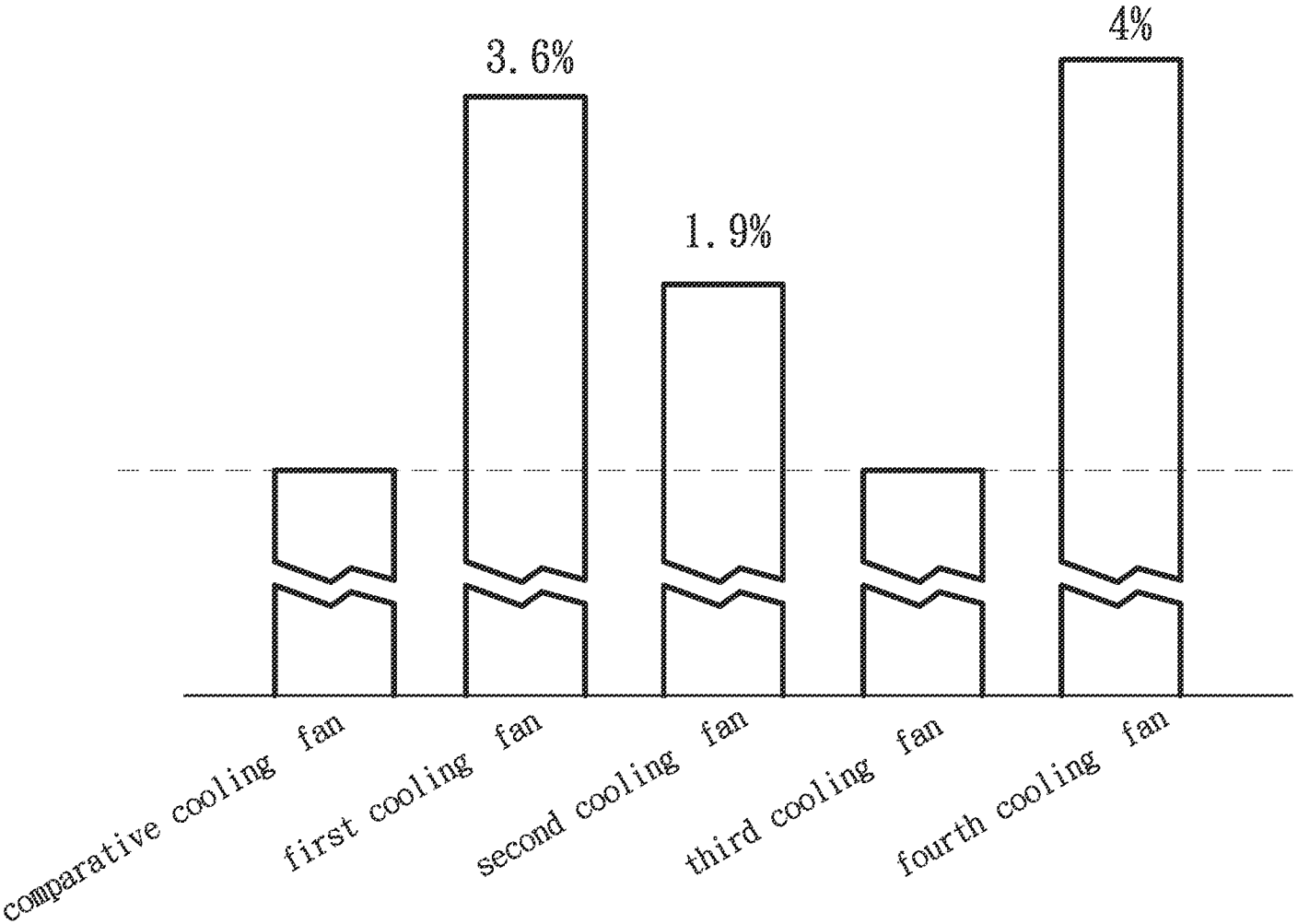
FIG. 14 is a bar chart illustrating the maximum airflows of a comparative cooling fan and first to fourth cooling fans according to the present invention at the same rotating speed.

With reference to FIG. 14, regarding the simulation result of the airflow, given the same impeller rotating speed of 5000 RPM, the maximum airflow of the fourth cooling fan can be increased by about 4% in comparison with the comparative cooling fan, the maximum airflow of the first cooling fan can be increased by about 3.6% in comparison with the comparative cooling fan, and the maximum airflow of the second cooling fan can be increased by about 1.9% in comparison with the comparative cooling fan. Therefore, the fourth cooling fan has the most significant airflow increasing effect, and the first cooling fan is the second best. Thus, it is proven that disposition pattern of the plurality of bulges 3 according to FIG. 2 can achieve a significant airflow increasing effect, and provision of the flow guiding plate 4 and the slot 1/1 (see FIG. 13) can further increase the airflow.

Figure 15:
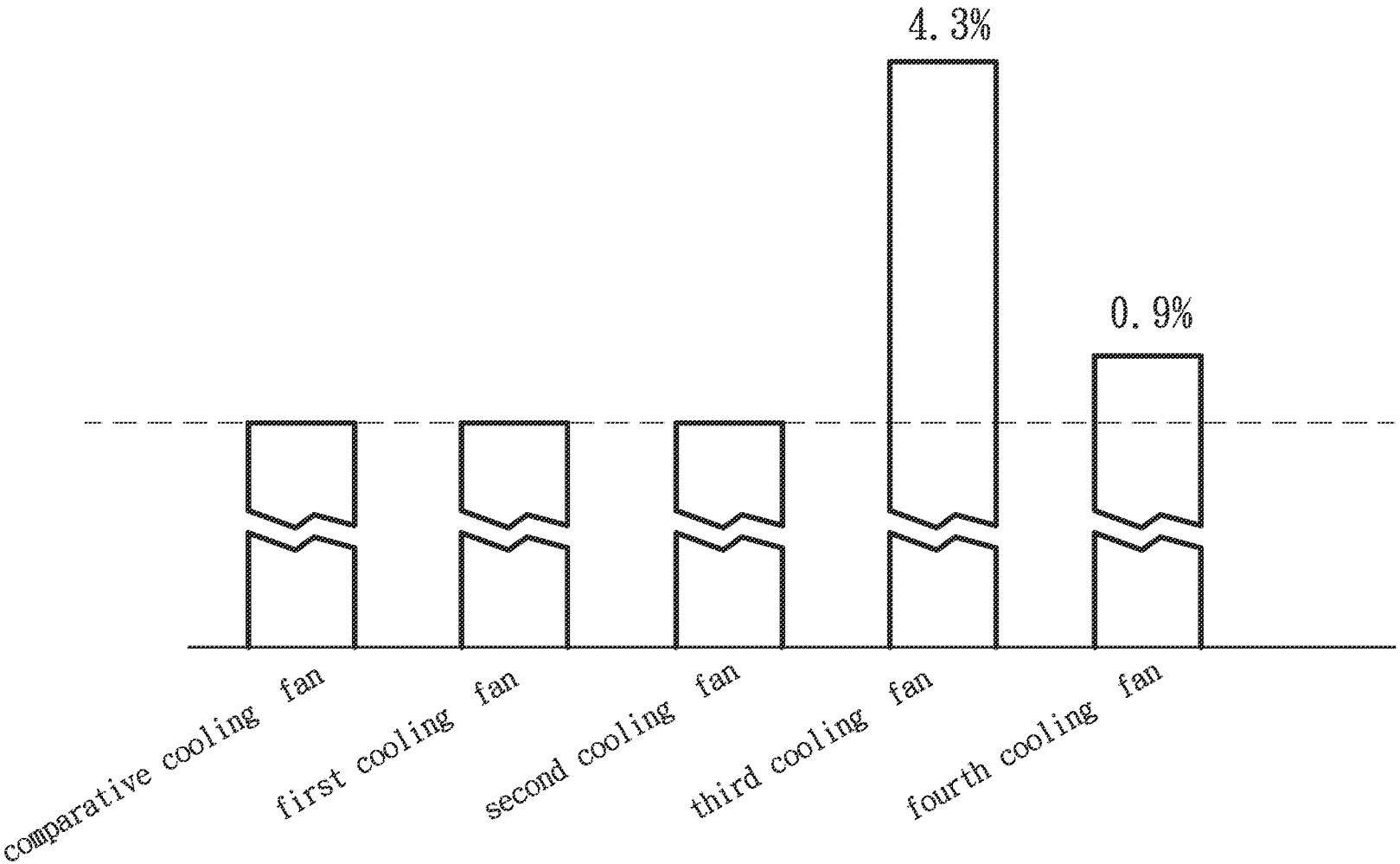
FIG. 15 is a bar chart illustrating the maximum static pressures of the comparative cooling fan and the first to fourth cooling fans according to the present invention at the same rotating speed.

With reference to FIG. 15, regarding the simulation result of the air pressure, given the same impeller rotating speed of 5000 RPM, the maximum static pressure of the third cooling fan can be increased by about 4.3% in comparison with the comparative cooling fan, and the maximum static pressure of the fourth cooling fan can be increased by about 0.9% in comparison with the comparative cooling fan. Therefore, the third cooling fan has the most significant air pressure increasing effect, and the fourth cooling fan is the second best. Thus, it is proven that disposition pattern of the plurality of bulges 3 on the inner face W of the lid 13 (see FIG. 7) can achieve a significant static pressure increasing effect, and provision of the flow guiding plate 4 and the slot 111 (see FIG. 13) also assist in the increase of the static pressure.

Regarding the simulation result of the operational noise, given the same impeller rotating speed of 5000 RPM, the comparative cooling fan has the largest acoustic power, whereas the acoustic powers of the first to fourth cooling fans are lowered, and the sound quality of the first cooling fan is the best. Thus, each of the cooling fans of the various embodiments according to the present invention has the effect of improving the sound quality to reduce operational noise.

According to the above simulation results, when the primary objective is increasing the airflow, the plurality of bulges 3 is disposed according to the disposition pattern shown in FIG. 2, and the flow guiding plate 4 and the slot 111 (see FIG. 13) are also provided, such that the airflow can be more significantly increased. When it is desired to increase the airflow and to reduce the noise, the plurality of bulges 3 may be disposed according to the disposition pattern shown in FIG. 2, and it is not necessary to provide the flow guiding plate 4 and the slot 111, such that the airflow can be obviously increased and the noise can be obviously reduced. When the primary objective is to increase the air pressure, the plurality of bulges 3 is disposed according to the disposition pattern shown in FIG. 7, such that the air pressure can be increased more significantly. When it is desired to increase both the airflow and the air pressure, the plurality of bulges 3 is disposed according to the disposition pattern shown in FIG. 2, and the flow guiding plate 4 and the slot 111 are also provided, such that the airflow can be significantly increased and the air pressure is slightly increased.

In view of the foregoing, in the cooling fan according to the present invention, the fan frame can be improved by a simple structure. By providing the plurality of bulges on the inner face of the sidewall and/or the inner face of the lid, the effects of increasing the airflow and the air pressure and/or reducing the noise can be achieved, thereby improving the performance of the cooling fan. Furthermore, in comparison with the conventional cooling fans, the cooling fan according to the present invention is easy to manufacture and form, increasing the production efficiency and yield.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A cooling fan comprising:

a fan frame including a substrate, a sidewall connected to the substrate, and a lid connected to the sidewall and opposite to the substrate, wherein an air inlet is formed in the lid, and wherein the substrate, the sidewall, and the lid together define at least one air outlet;

an impeller rotatably mounted in the fan frame; and a plurality of bulges protruding from an inner face of the sidewall and/or an inner face of the lid;

wherein each of the plurality of bulges has a maximum width ranging between 1.25 and 1.5 mm.

2. The cooling fan as claimed in claim 1, wherein a first reference plane extends parallel to the at least one air outlet and passes through an axis of the impeller, wherein an output zone is formed between the first reference plane and the at least one air outlet, and wherein at least a half of a quantity of the plurality of bulges is located in the output zone.

3. The cooling fan as claimed in claim 2, wherein a portion of the inner face of the sidewall forms a tail section contiguous to the at least one air outlet, and wherein at least 80% of the quantity of the plurality of bulges on the sidewall is located in the tail section.

4. The cooling fan as claimed in claim 1, wherein the sidewall includes a tongue adjacent to the at least one air outlet, wherein the inner face of the sidewall has an outwardly enlarged section and a tail section, wherein the outwardly enlarged section is connected to the tongue and extends to the at least one air outlet, wherein the tail section is contiguous to the at least one air outlet and is opposite to the tongue, wherein the plurality of bulges on the sidewall is disposed from the tail section along the inner face of the sidewall to a position adjacent to the tongue, and wherein the plurality of bulges is neither disposed on the tongue nor the outwardly enlarged section.

5. The cooling fan as claimed in claim 1, wherein the plurality of bulges on the sidewall is located between a half of a height of the inner face of the sidewall and an intersection of the sidewall and the substrate.

6. The cooling fan as claimed in claim 5, wherein the plurality of bulges on the sidewall is contiguous to the intersection of the sidewall and the substrate.

7. The cooling fan as claimed in claim 6, wherein all of the plurality of bulges is located on the sidewall.

8. The cooling fan as claimed in claim 1, wherein a portion of the inner face of the sidewall forms a tail section, wherein the tail section is contiguous to the at least one air outlet, wherein a second reference plane is orthogonal to the at least one air outlet and passes through an axis of the impeller, and wherein the plurality of bulges on the lid is located between the tail section and the second reference plane.

9. The cooling fan as claimed in claim 8, wherein a first reference plane extends parallel to the at least one air outlet and passes through an axis of the impeller, wherein an output zone is formed between the first reference plane and the at least one air outlet, and wherein the plurality of bulges is located in the output zone.

10. The cooling fan as claimed in claim 1, further comprising a flow guiding plate located in the at least one air outlet, wherein the flow guiding plate has two ends connected to the inner face of the sidewall.

11. The cooling fan as claimed in claim 10, wherein the fan frame includes a supporting peg located in the at least one air outlet, wherein the supporting peg is connected to the substrate and/or the lid, and wherein the flow guiding plate is coupled to the supporting peg.

12. The cooling fan as claimed in claim 10, wherein a cross sectional shape of the flow guiding plate is in a form of an airfoil.

13. The cooling fan as claimed in claim 10, wherein the impeller includes a plurality of blades, and wherein an edge of the flow guiding plate facing the impeller is aligned with 40-60% of a height of the plurality of blades.

14. The cooling fan as claimed in claim 10, wherein the substrate includes a slot extending parallel to the at least one air outlet, wherein the slot is located below the flow guiding plate, and wherein an area of a projection of the flow guiding plate on the substrate at least partially overlaps with the slot.

15. The cooling fan as claimed in claim 1, wherein a height of the inner face of the sidewall is smaller than or equal to eight times a thickness of each of the plurality of bulges protruding from the inner face of the sidewall.

16. The cooling fan as claimed in claim 1, wherein each of the plurality of bulges has a thickness protruding beyond the sidewall and/or the lid and ranging between 0.25 and 0.5 mm.

* * * * *